US006545453B2

(12) United States Patent
Glinkowski et al.

(10) Patent No.: US 6,545,453 B2
(45) Date of Patent: Apr. 8, 2003

(54) SYSTEMS AND METHODS FOR PROVIDING VOLTAGE REGULATION EXTERNALLY TO A POWER TRANSFORMER

(75) Inventors: Mietek T. Glinkowski, Raleigh, NC (US); Mark Perkins, St. Charles, MO (US)

(73) Assignee: ABB Inc., Raleigh, NC (US)

( * ) Notice: Subject to any disclaimer, the term of this patent is extended or adjusted under 35 U.S.C. 154(b) by 0 days.

(21) Appl. No.: 09/825,455

(22) Filed: Apr. 3, 2001

(65) Prior Publication Data

US 2003/0006748 A1 Jan. 9, 2003

(51) Int. Cl.[7] ..... H01F 27/42
(52) U.S. Cl. ..... 323/356
(58) Field of Search ..... 323/355, 356, 323/358, 361, 363, 305

(56) References Cited

U.S. PATENT DOCUMENTS

| | | | | |
|---|---|---|---|---|
| 905,509 A | | 12/1908 | Fleischmann | |
| 2,647,253 A | | 7/1953 | Mackenzie et al. | 340/310 |
| 2,866,152 A | | 12/1958 | Prior | 323/44 |
| 3,053,920 A | | 9/1962 | Seitz | 13/26 |
| 3,845,437 A | | 10/1974 | Goodman | 336/147 |
| 3,938,031 A | | 2/1976 | Blackmond | 323/23 |
| 3,992,661 A | | 11/1976 | Kelley, Jr. | 323/102 |
| 4,039,926 A | * | 8/1977 | Steigerwald | 363/138 |
| 4,188,619 A | | 2/1980 | Perkins | 340/310 R |
| 4,473,816 A | | 9/1984 | Perkins | 340/310 R |
| 4,602,240 A | | 7/1986 | Perkins et al. | 340/310 R |
| 4,689,735 A | | 8/1987 | Young | 363/155 |
| 5,063,487 A | | 11/1991 | Johnson et al. | 363/3 |
| 5,093,614 A | | 3/1992 | Woodworth | 323/361 |
| 5,646,512 A | | 7/1997 | Beckwith | 323/257 |
| 5,886,891 A | * | 3/1999 | Jiang et al. | 363/84 |
| 6,011,704 A | | 1/2000 | Coleman | 363/37 |

* cited by examiner

*Primary Examiner*—Matthew Nguyen
(74) *Attorney, Agent, or Firm*—Woodcock Washburn LLP

(57) ABSTRACT

Voltage regulation of power transformers by the use of a separate, removable, detachably coupled device external to the main transformer that can be attached to a main transformer unit when voltage regulation is desired. The device is connected to the three neutrals of the main transformer and can comprise: (a) a bank of three capacitors connected in wye, (b) a bank of three medium voltage (MV) or low voltage (XV) transformers, (c) one three-phase low voltage or medium voltage transformer, or (d) a combination of a XV/MV transformer and a capacitor bank.

11 Claims, 8 Drawing Sheets

SYSTEMS AND METHODS FOR PROVIDING VOLTAGE REGULATION EXTERNALLY TO A POWER TRANSFORMER

FIELD OF THE INVENTION

The present invention relates in general to alternating current power supplies. More particularly, the present invention relates to improving voltage regulation in alternating current electric power systems.

BACKGROUND OF THE INVENTION

It is known that electric power systems which have large inherent system reactance and/or supply highly reactive loads are characterized by poor voltage regulation, i.e., substantial change in the magnitude of load voltage as load current fluctuates. In a typical inductive circuit, voltage magnitude and power factor both decrease as load current increases. To improve voltage regulation, power transformers are commonly provided with load tap changers to counteract the tendency of voltage magnitude to change with change in load current. FIG. 1 is a schematic diagram of a prior art transformer 10 incorporating a conventional load tap changer 20. Also shown are terminals 12, 14, and 16.

Traditional voltage regulation for power transformers includes either no-load or under-load taps that connect directly to either primary or secondary windings of the supply transformer with switching means to change the tap connections for the desired voltage range as required by the resistance of the load. This approach requires complex design arrangements and causes several undesired effects such as reduction in the ability to withstand transient by the transformer windings, uneven short circuit forces during faults, reduced dielectric performance, higher overall costs, and larger dimensions of the transformers.

Voltage regulation using transformer taps typically uses off-load taps in the main transformer winding, a regulating winding, an off-load tap changer, an on-load tap changer, or auxiliary transformers. Taps add considerable cost to a standard transformer design: about a 4 to 10 percent increase for off-load taps and about a 20 to 30 percent increase for on-load taps. It is also more difficult and time consuming to manufacture such a system, typically taking about 30 to 40 percent more hours to manufacture a transformer with taps. Moreover, taps distort the leakage flux in the windings, and lead to higher eddy losses and circulating currents, higher localized heating and hot spots, and higher short-circuit forces. Furthermore, there is higher transient stress at the tap regions which affects the thermal performance and could cause dielectric failure. Moreover, tap changers are unreliable, with over 40 percent of field failures being attributed to tap changer failures.

SUMMARY OF THE INVENTION

The present invention is directed to the voltage regulation of power transformers by the use of a separate, removable, detachably coupled device external to the main transformer that can be attached to a main transformer unit when voltage regulation is desired. The device is connected to the three neutrals of the main transformer and can comprise: (a) a bank of three capacitors connected in wye, (b) a bank of three medium voltage (MV) or low voltage (XV) transformers, (c) one three-phase low voltage or medium voltage transformer, or (d) a combination of a XV/MV transformer and a capacitor bank.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings an embodiment that is presently preferred, it being understood, however, that the invention is not limited to the specific methods and instrumentalities disclosed. In the drawings.

DESCRIPTION OF EXEMPLARY EMBODIMENTS AND BEST MODE

The present invention is directed to the voltage regulation of power transformers by the use of a separate, removable, detachably coupled device external to the main transformer that can be attached to a main transformer unit when voltage regulation is desired. The device is connected to the three neutrals of the main transformer and can comprise, but is not limited to, one of the following, as described in more detail below: (a) a bank of three capacitors connected in wye, (b) a bank of three medium voltage (MV) or low voltage (XV) transformers, (c) one three-phase low voltage or medium voltage transformer, (d) a combination of a XV/MV transformer and a capacitor bank.

Figure 1:
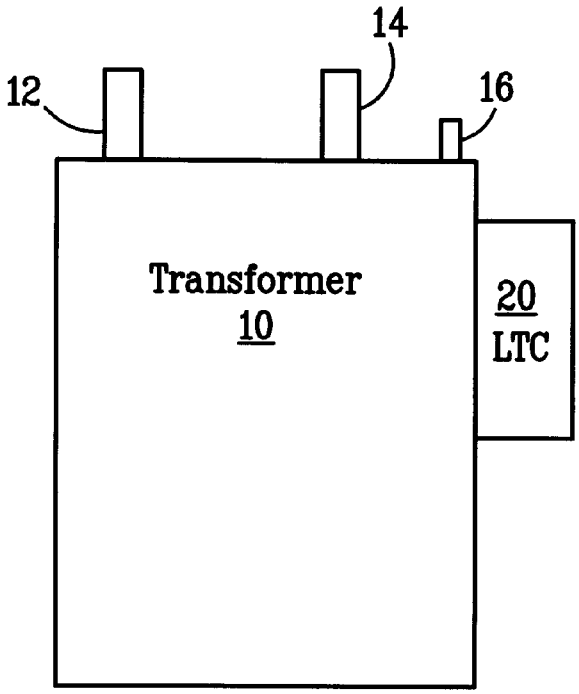
FIG. 1 Prior Art
FIG. 1 is a schematic diagram of a prior art transformer incorporating a load tap changer.
Figure 2:
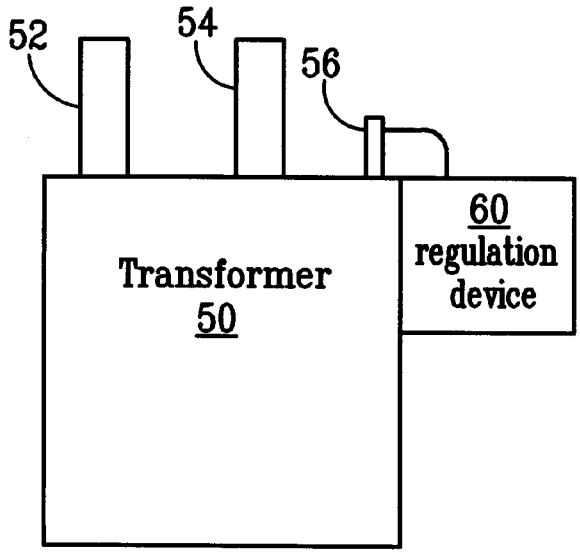
FIG. 2 is a schematic diagram of an exemplary transformer system in accordance with the present invention.

FIG. 2 is a schematic diagram of an exemplary transformer system in accordance with the present invention. A transformer 50, which can be a conventional transformer, having terminals 52, 54, and 56, is detachably coupled or attached to an external regulation device 60, described in more detail below. The device 60 is connected to the transformer via three neutral terminals 56. No taps or regulation windings in the transformer 50 are required.

Figure 3A:
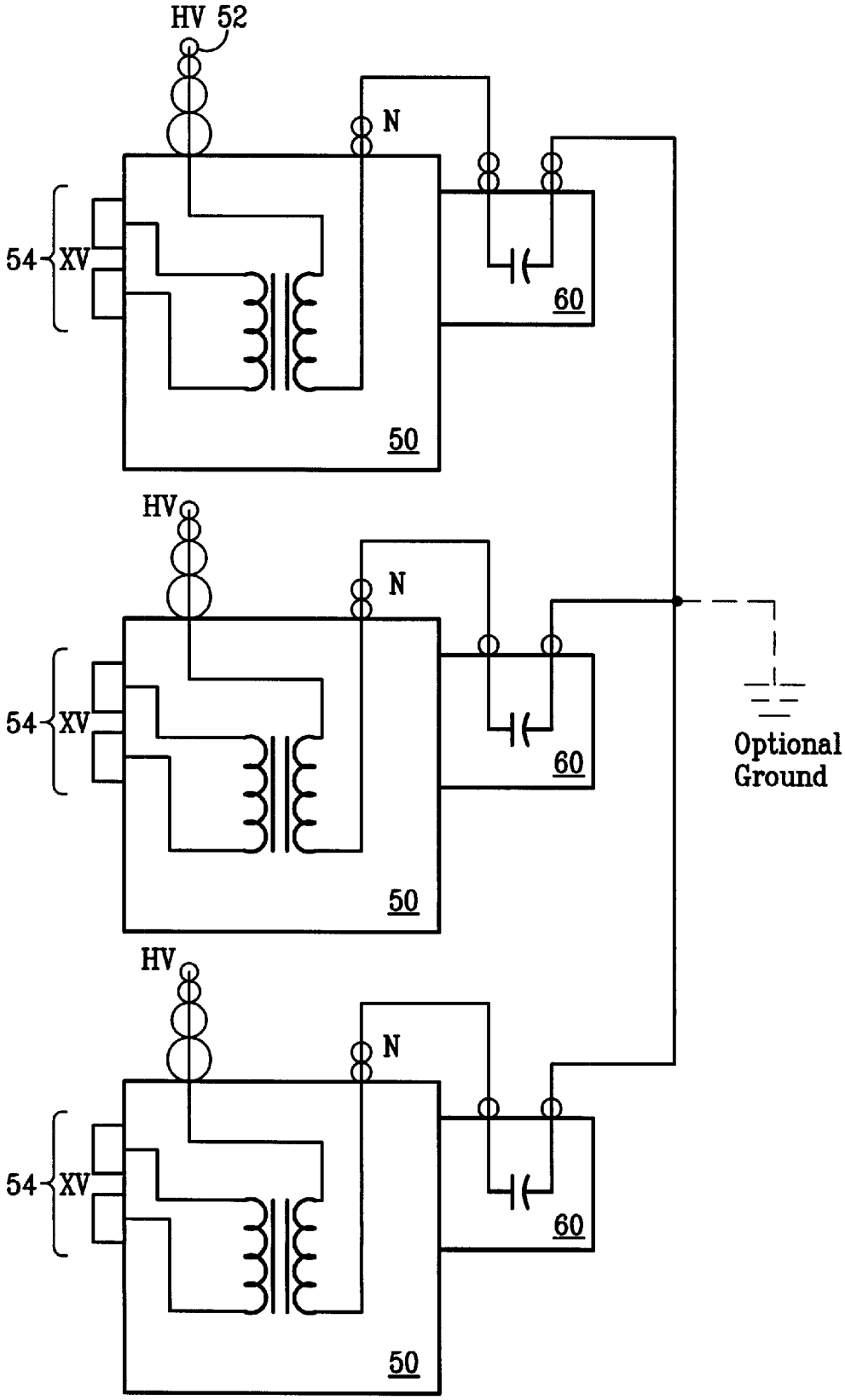
FIGS. 3A, 3B, 3C, and 3D are schematic circuit diagrams of exemplary transformer systems in accordance with the present invention.
Figure 3B:
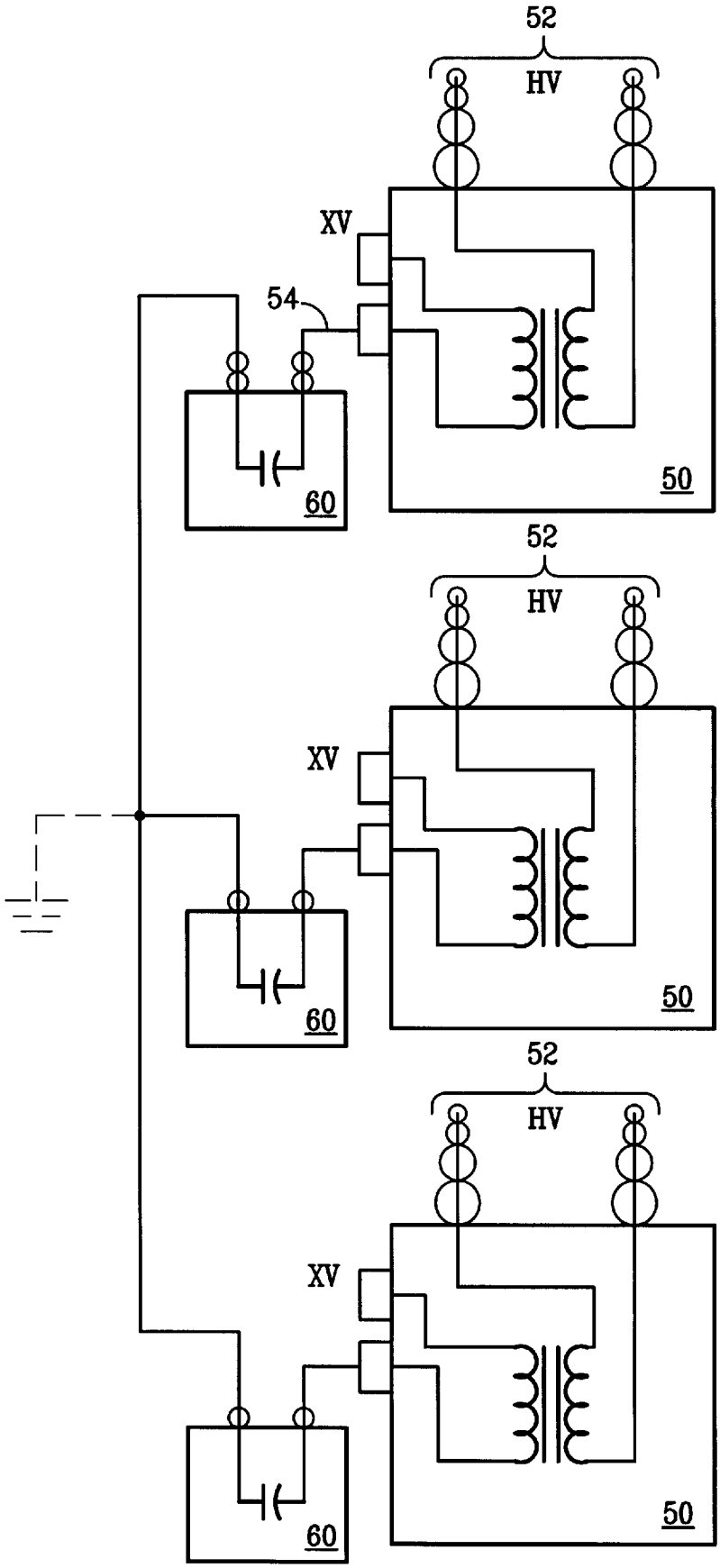

FIGS. 3A, 3B, 3C, and 3D are schematic circuit diagrams of exemplary transformer systems in accordance with the present invention. In FIG. 3A, three single-phase transformers are connected in wye (star) on an HV (high voltage; e.g., greater than or equal to about 38 kV) winding. The XV (low voltage; e.g., less than or equal to about 1500 V) winding can be either delta or wye. In FIG. 3B, three single-phase transformers are connected in wye on an XV winding. The HV winding can be either delta or wye. It should be noted that the XV windings shown could also be medium voltage (e.g., between about 1500 V and about 38 kV).

Figure 3C:
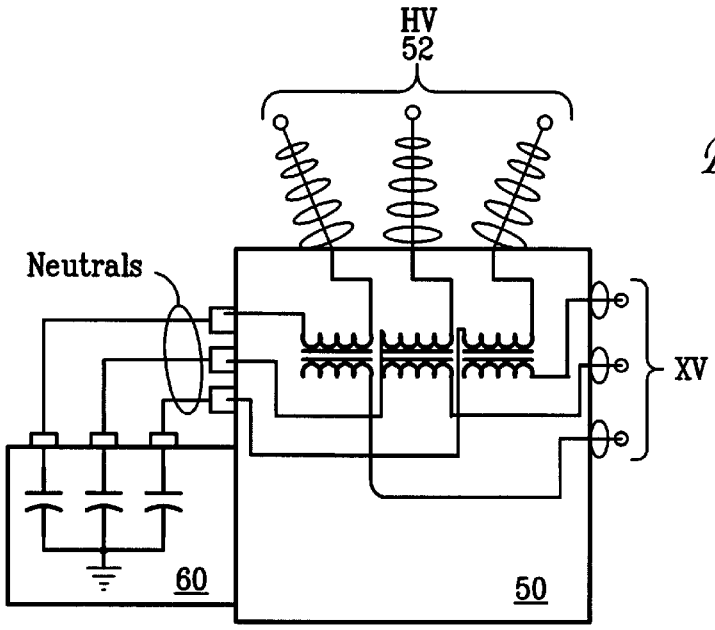
Figure 3D:
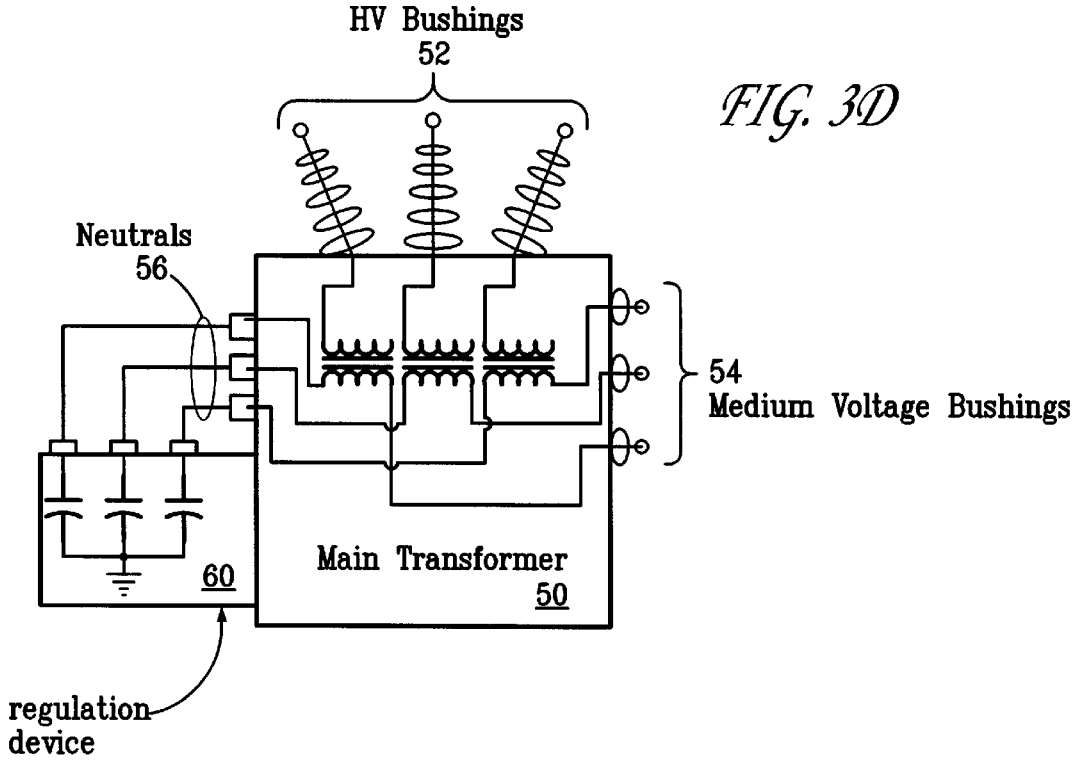

In FIG. 3C, athree-phase transformer has wye connected primary, while FIG. 3D shows a three-phase transformer has wye connected secondary. In FIG. 3C, the HV winding is connected in wye (star) and the XV winding can be either delta or wye. On the other hand, in FIG. 3D, the XV winding is connected in wye and the HV winding can be either delta or wye.

In FIGS. 3A–3D, the voltage regulation device 60 is external to the main transformer 50. This allows for the voltage regulation device 60 to be easily disconnected for service or replacement, for example, and re-connected. The other winding that is not connected to the regulation device 60 (i.e., the primary or the secondary), can be connected in either delta or wye. In this manner, the combination of connections shown in Table 1 can be achieved.

TABLE 1

| Primary winding (HV) | Secondary winding (XV) |
|---|---|
| wye | wye |
| wye | delta |
| delta | wye |

Figure 4:
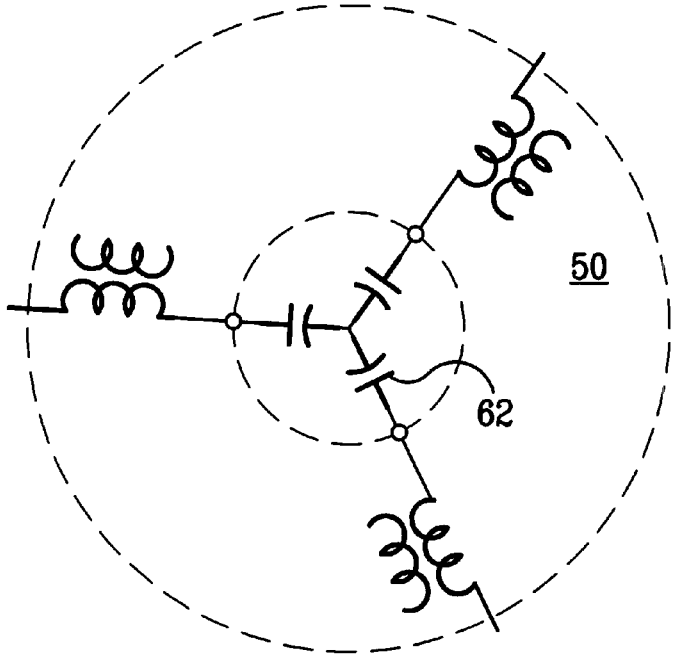
FIG. 4 is a schematic diagram of an exemplary voltage regulator in accordance with the present invention.

FIG. 4 is a schematic diagram of an exemplary voltage regulator in accordance with the present invention. According to this embodiment, the external regulation device 60 comprises a three-capacitor bank, comprising capacitors 62, and is used for on-load voltage regulation. The capacitors 62 are attached to the neutral terminals 56 of the main transformer 50. This can compensate for the inductive voltage drop of the transformer Zsc and the transmission line Z. This arrangement provides dynamic voltage regulation automatically depending on the load current. The main transformer 50 can have a higher Zsc, and thus a lower cost. Moreover, with higher Zsc, there is a lower system fault current when the capacitor is bypassed. Thus, a bank of capacitors 62 are connected in series with the main transformer winding on the neutral side of the main transformer 50 to accomplish dynamic voltage regulation by canceling the voltage drop resulting from the short circuit impedance of the main transformer 50 as well as the equivalent impedance of the power system.

More particularly, The regulation device 60 comprises three capacitors 62 connected in wye (star) with their three star terminals connected to the three neutral points of the transformer windings 50. The other windings of the three transformers can be connected either in delta or wye.

Figure 5A:
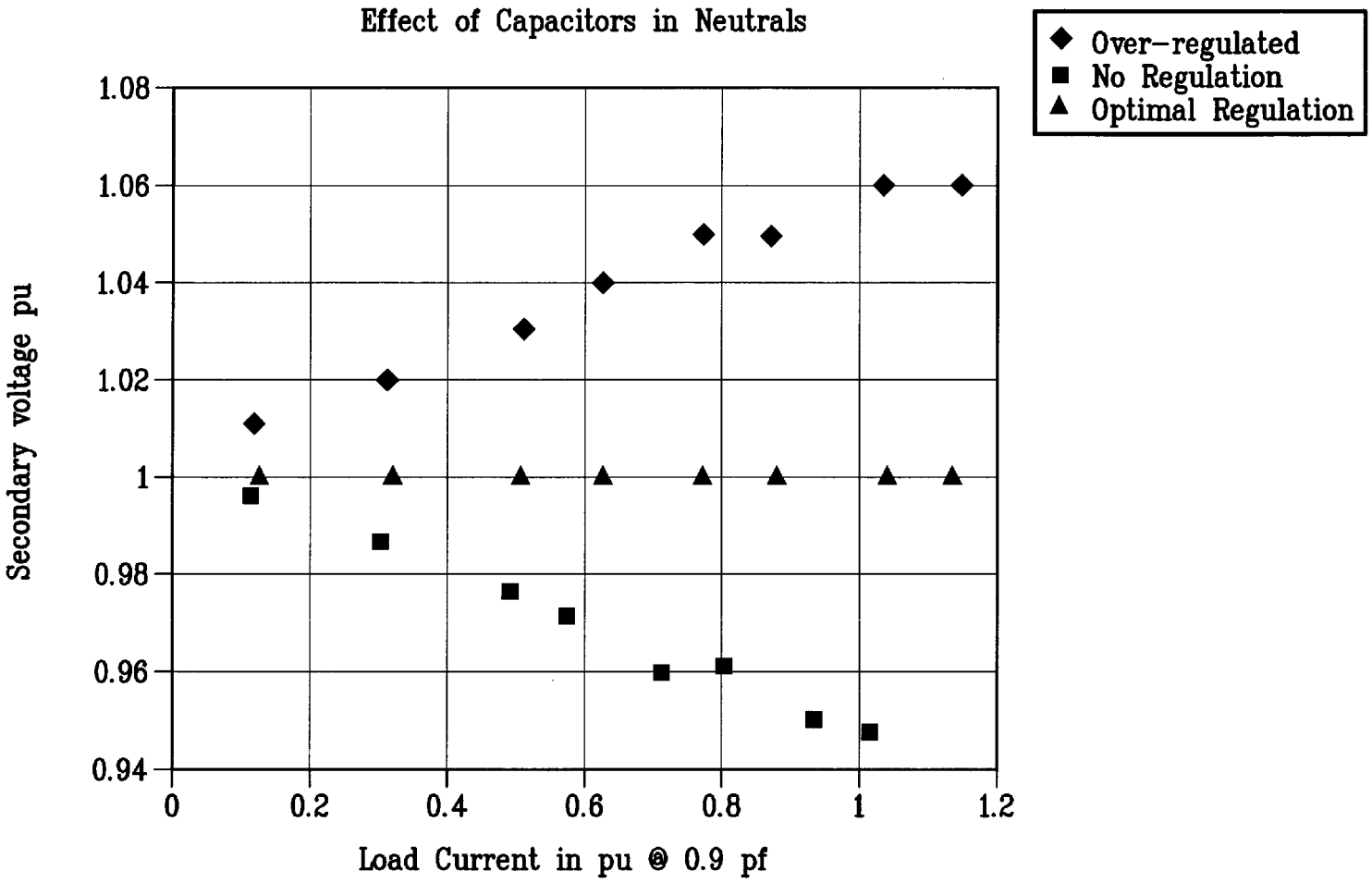
FIG. 5A is a chart showing voltage regulation effect on the secondary of an exemplary transformer winding compensated by a neutral capacitor regulation device versus load current in accordance with the present invention.

FIG. 5A is a chart showing voltage regulation on the secondary of an exemplary transformer winding compensated by a neutral capacitor regulation device versus load current in accordance with the present invention. When a conventional power transformer carries a load current, the voltage of the secondary winding drops proportionally due to the drop across the transformer and system reactances (see squares in FIG. 5A). When capacitors 62 are connected in series with the windings of the transformer 50, the capacitive reactance cancels the inductive reactance of the transformer and the system and therefore eliminates the unwanted voltage drop. When these two reactances are equal, the desired regulation occurs (see triangles in FIG. 5A). It is also possible to achieve a voltage rise by overcompensating the system using capacitors with lower capacitance values than in the above case (triangles) (see diamonds in FIG. 5A). Using the capacitors eliminates the need for conventional load tap changers. The capacitor bank has no moving parts, uses no control signal and can maintain the constant voltage automatically. It is external to the transformer so it is easily disconnectable, maintainable, and replaceable without affecting the operation of the main transformer.

Figure 5B:
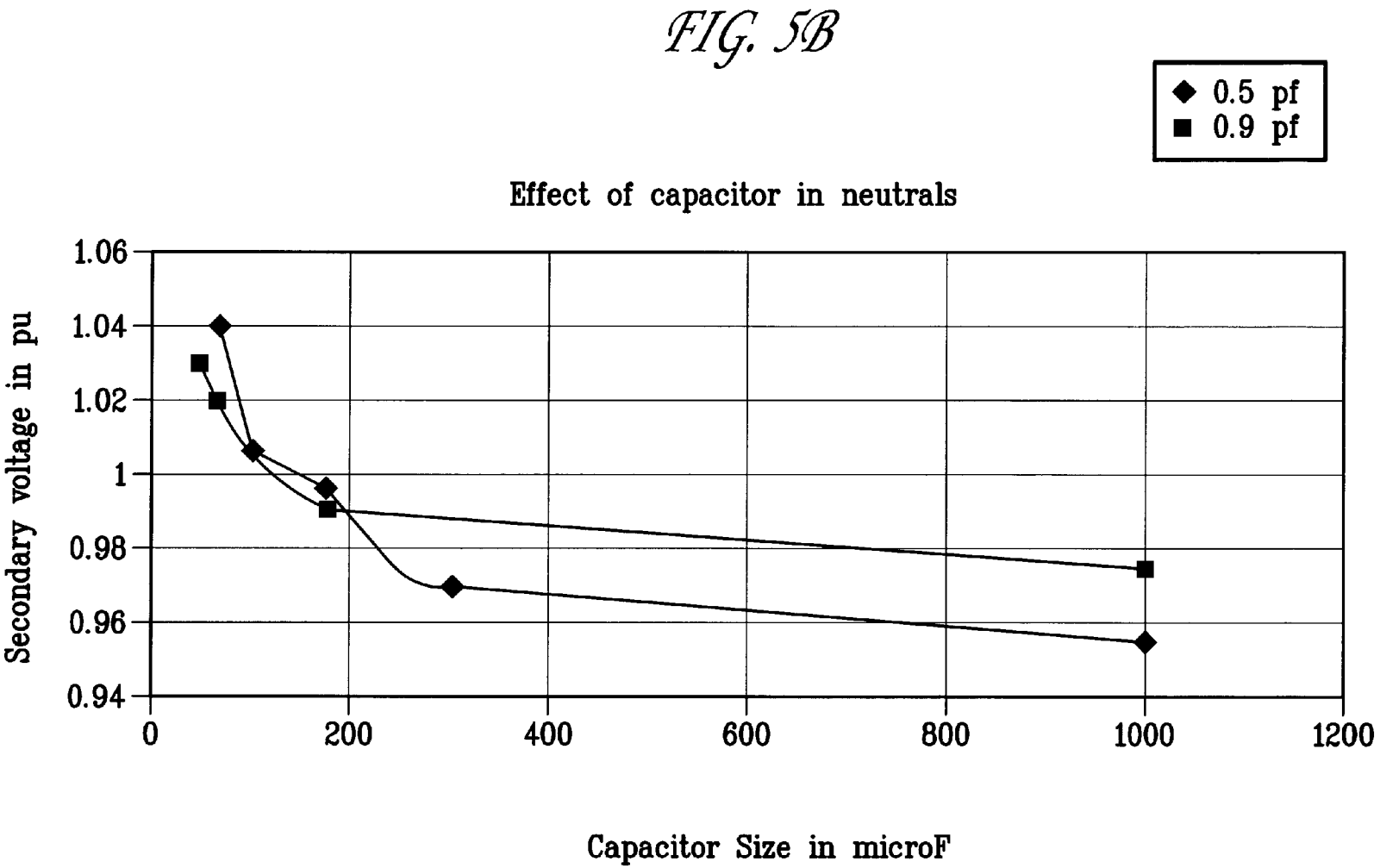
FIG. 5B is a chart showing voltage on the secondary of an exemplary transformer versus the capacitance in the neutrals in accordance with the present invention.

It is also possible to vary the amount of regulation by varying (switching) the capacitance, as shown in FIG. 5B. FIG. 5B is a chart showing voltage on the secondary of an exemplary transformer versus the capacitance in the neutrals in accordance with the present invention. In this manner, switching capacitances in lumped increments or by thyristor controlled valves are used.

Figure 6:
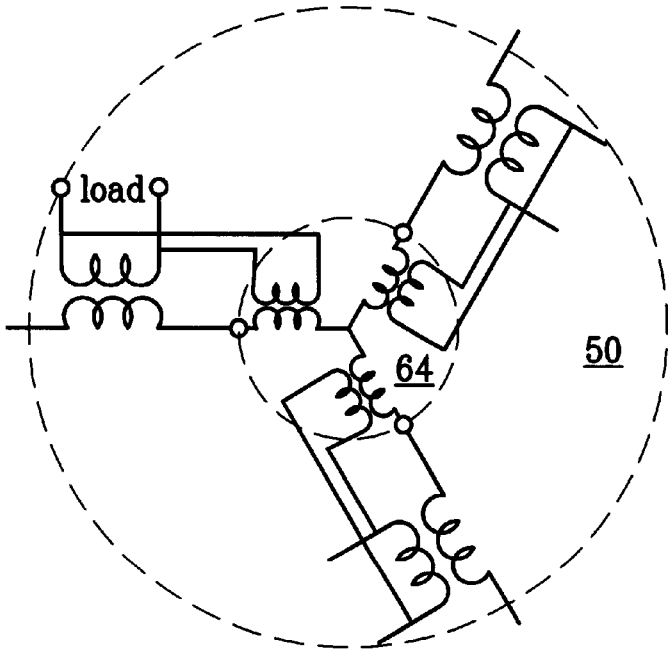
FIG. 6 is a schematic diagram of another exemplary voltage regulator utilizing transformers rather than capacitors in accordance with the present invention.

FIG. 6 is a schematic diagram of another exemplary voltage regulator in accordance with the present invention. A bank of small distribution-type transformers 64 (e.g., having about 10% or less of the main power transformer rating) is attached in series to the neutrals of the main transformer 50 for static or off-load voltage regulation. This arrangement can compensate for seasonal changes in system voltage. Thus, a small distribution-type transformer is connected in series with the main power transformer winding on the neutral side of the main transformer to accomplish passive (no-load) voltage regulation by inserting a small voltage proportional to the secondary voltage of the main transformer.

More particularly, FIG. 6 depicts an external regulation device 64 comprising three small distribution transformers inserted in the neutrals of the main transformer 50. The small distribution transformers can act as the de-energized (off-load) tap changer adding (or subtracting) the incremental voltage to the neutrals of the main transformer primary windings from the secondary windings of the main transformers. The distribution transformers are connected in parallel in the secondary windings and in series (in the neutrals) in the primary windings.

This voltage regulation is neither automatic nor dynamic. It is a fixed-step voltage addition or subtraction. The advantages of the embodiment are that the device 64 is external to, and easily detachable from, the main transformers and there is no moving parts.

Figure 7:
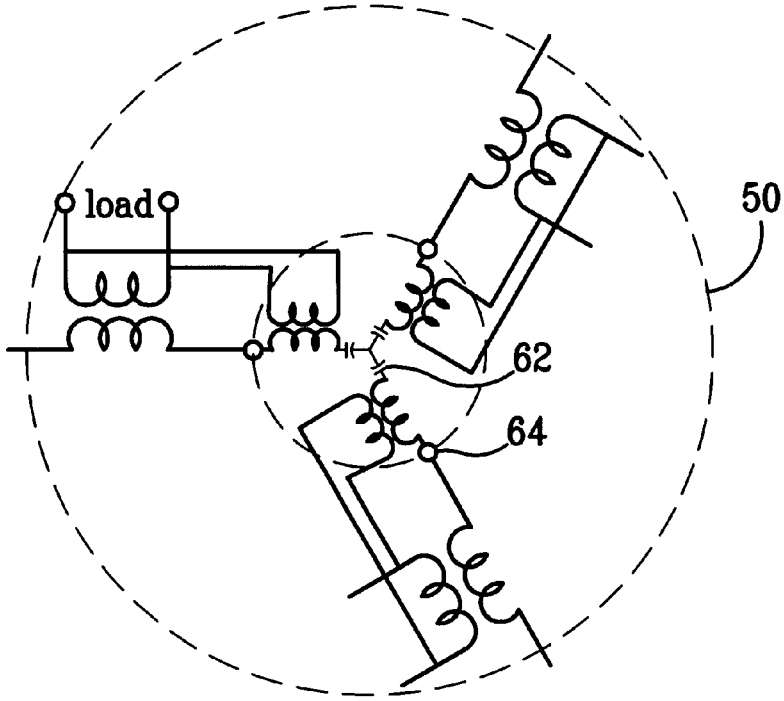
FIG. 7 is a schematic diagram of another exemplary voltage regulator in accordance with the present invention.

FIG. 7 is a schematic diagram of another exemplary voltage regulator in accordance with the present invention. This embodiment provides both static (passive) as well as dynamic voltage regulation externally to the main transformer 50 by using a bank of capacitors 62 in series with a small distribution type transformer 64 in series with the main winding of the power transformer 50 on the neutral side of the power transformer 50.

More particularly, FIG. 7 illustrates an embodiment that combines embodiments described above. The capacitor bank portion 62 of the regulation device provides dynamic, automatic, load-current dependent voltage regulation, whereas the small transformer part 64 provides a step-like fixed voltage boost or buck.

Figure 8:
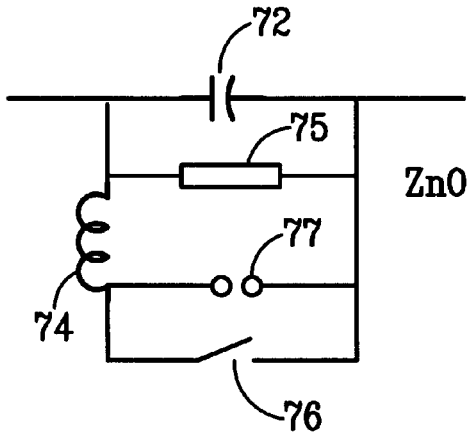
FIG. 8 is a schematic diagram of an exemplary device for reducing short circuit currents and protecting voltage regulation capacitors in accordance with the present invention.

FIG. 8 is a schematic diagram of an exemplary device for reducing short circuit currents and for protecting the capacitors in accordance with the present invention. The device 70 comprises a neutral capacitor 72 with an inductor 74, spark gap 77, and a bypass switch 76. The device reduces the short circuit currents during system faults by bypassing the bank of capacitors 62, described above, by the inductor 74 with a protective spark gap 77 or switch 76 and therefore increasing the overall total short circuit impedance of the combination of the main transformer 50 and the bypassed bank of capacitors 62.

For example, the device 70 can be used to protect a capacitor-based regulation device, such as that described with respect to FIG. 4. It is contemplated that each of the three capacitors in FIG. 4 will have to have its own protection circuit or device 70. The protection functions in the following way. When the voltage across the capacitor exceeds a safe value, for example due to an overload or short circuit current, first the zinc oxide (ZnO) arrester 75 clips the voltage to a safe level. If the overvoltage continues for a longer time, beyond the energy rating of ZnO, the spark gap 77 operates to discharge the excess voltage from the capacitor 72 through the inductor 74. If this overvoltage condition continues for even longer time, a mechanical switch 76 closes to protect the spark gap from the excess of the capacitor energy.

It should be noted that the regulation device 60 can be rated only a fraction of the main power rating of the main power transformer, such as, for example, between about 5 and 15 percent of the main unit.

The advantages of such a separate, add-on voltage regulation include: (a) simplifying and standardizing the design of the main power transformers, (b) reducing the cost of the transformers by not requiring taps, (c) reducing the size of the main transformer, (d) providing static as well as dynamic voltage regulation, and (e) better and more flexible maintenance access to the small add-on device without the need of disconnecting the main transformer.

The size of main power transformers can thus be reduced by eliminating the winding taps and providing tap-less voltage regulation. Therefore, the design and construction of main power transformers can be simplified by eliminating winding taps and increasing the transformer short circuit impedance.

Because the voltage regulator of the present invention can be applied to any three-phase or single-phase transformer, it is suitable to all different transformer constructions, for example, liquid-filled as well as dry-type. It is attractive to cable-type transformers as well considering particular difficulties with bringing out the conventional taps in the cable-transformer transformer (Torr transformer). Because the present invention does not require any taps in the main power transformer, it solves the difficult problem of voltage regulation in the cable-type transformer units.

Although illustrated and described herein with reference to certain specific embodiments, it will be understood by those skilled in the art that the invention is not limited to the embodiments specifically disclosed herein. Those skilled in the art also will appreciate that many other variations of the specific embodiments described herein are intended to be within the scope of the invention as defined by the following claims.

What is claimed:

1. A transformer system for use in an electric power system, comprising:

a power transformer; and a voltage regulation device detachably coupled to the transformer and external to the transformer, the voltage regulation device regulating the magnitude of the voltage of the transformer.

2. The system according to claim 1, wherein the regulation device comprises a bank of three capacitors connected in wye.

3. The system according to claim 2, wherein the bank of capacitors is connected in series with a main transformer winding on the neutral side of the transformer.

4. The system according to claim 1, wherein the regulation device comprises a bank of three single-phase transformers, the transformers being one of medium voltage and low voltage.

5. The system according to claim 1, wherein the regulation device comprises a three-phase voltage transformer, the voltage transformer being one of medium voltage and low voltage.

6. The system according to claim 1, wherein the regulation device comprises a small distribution-type transformer, the small distribution-type transformer being connected in series with a main transformer winding on the neutral side of the transformer.

7. The system according to claim 1, wherein the regulation device comprises a capacitor bank in series with a small distribution-type transformer, the capacitor bank and small distribution-type transformer being connected in series with a main winding of the transformer on the neutral side of the transformer.

8. The system according to claim 1, wherein the transformer comprises a plurality of neutral terminals and the regulation device is detachably coupled to the neutral terminals.

9. The system according to claim 1, wherein the regulation device is devoid of a tap.

10. The system according to claim 1, further comprising an inductor with a protective spark gap or switch for reducing short circuit currents.

11. The system according to claim 10, wherein the inductor with the protective spark gap or switch is connected between the transformer and the regulation device.

* * * * *